US006675733B2

(12) United States Patent
Hoshina

(10) Patent No.: US 6,675,733 B2
(45) Date of Patent: Jan. 13, 2004

(54) REMOTE CONTROL DEVICE FOR SMALL VESSEL

(75) Inventor: Yoshikazu Hoshina, Yokohama (JP)

(73) Assignee: NHK Morse Co., Ltd., Yokohama (JP)

( * ) Notice: Subject to any disclaimer, the term of this patent is extended or adjusted under 35 U.S.C. 154(b) by 145 days.

(21) Appl. No.: 10/005,546

(22) Filed: Oct. 29, 2001

(65) Prior Publication Data

US 2002/0090866 A1 Jul. 11, 2002

(30) Foreign Application Priority Data

Oct. 31, 2000 (JP) ..... 2000-333774

(51) Int. Cl.[7] ..... B63H 25/00

(52) U.S. Cl. ..... 114/144 A; 114/144 RE; 440/86

(58) Field of Search ..... 114/144 RE, 144 A; 440/6, 84–87; 200/5 R, 5 A, 6 A, 329, 331, 332, 335, 339; 446/454, 456; 43/26.1; 318/581, 588, 589

(56) References Cited

U.S. PATENT DOCUMENTS

| | | | | | |
|---|---|---|---|---|---|
| 3,865,063 | A | * | 2/1975 | Norton | 114/144 R |
| 3,867,600 | A | * | 2/1975 | Phillips | 200/52 A |
| 4,085,301 | A | * | 4/1978 | Smith | 200/4 |
| 4,231,310 | A | * | 11/1980 | Muramatsu | 114/144 RE |
| 4,253,349 | A | * | 3/1981 | Floeter et al. | 477/113 |
| 4,739,236 | A | | 4/1988 | Burkenpas | |
| 4,744,322 | A | * | 5/1988 | Nakase | 114/144 E |
| 4,810,216 | A | * | 3/1989 | Kawamura | 440/2 |
| 4,946,411 | A | * | 8/1990 | Novey | 440/84 |
| 4,947,009 | A | * | 8/1990 | Osika et al. | 200/43.16 |
| 5,095,181 | A | * | 3/1992 | Osika et al. | 200/43.16 |
| 5,165,193 | A | * | 11/1992 | Dankwardt | 43/26.1 |
| 5,293,712 | A | * | 3/1994 | Lo | 43/26.1 |
| 5,295,890 | A | * | 3/1994 | Myers | 446/176 |
| 5,309,664 | A | * | 5/1994 | Wright | 43/26.1 |
| 5,395,274 | A | * | 3/1995 | Myers | 446/16 |
| 5,741,166 | A | * | 4/1998 | Newman | 440/84 |
| 5,859,517 | A | * | 1/1999 | DePasqua | 318/581 |

FOREIGN PATENT DOCUMENTS

| | | | | | |
|---|---|---|---|---|---|
| DE | 29706745 | U1 | * | 6/1997 | B63H/25/02 |
| JP | 63312295 | A | * | 12/1988 | B63H/21/22 |
| JP | 10045095 | A | * | 2/1998 | B63H/25/04 |
| JP | 10148523 | A | * | 6/1998 | G01C/13/00 |
| JP | 2002068086 | A | * | 3/2002 | B63H/25/42 |
| JP | 2002154479 | A | * | 5/2002 | B63B/35/79 |
| JP | 2002234494 | A | * | 8/2002 | B63H/25/00 |

* cited by examiner

*Primary Examiner*—S. Joseph Morano
*Assistant Examiner*—Ajay Vasudeva
(74) *Attorney, Agent, or Firm*—Frishauf, Holtz, Goodman & Chick, P.C.

(57) ABSTRACT

A remote control device comprises a portable housing, control levers, steering knob, locking mechanisms, selector switch, indicators, emergency stop switch, etc. The locking mechanisms can hold the control levers in a neutral position. The housing contains therein potentiometers adapted to deliver electric signal for engine control when the control levers are moved back and forth and a potentiometer adapted to deliver electric signal for driving a steering mechanism when the steering knob is moved from side to side.

16 Claims, 6 Drawing Sheets

REMOTE CONTROL DEVICE FOR SMALL VESSEL

CROSS-REFERENCE TO RELATED APPLICATIONS

This application is based upon and claims the benefit of priority from the prior Japanese Patent Application No. 2000-333774, filed Oct. 31, 2000, the entire contents of which are incorporated herein by reference.

BACKGROUND OF THE INVENTION

1. Field of the Invention

The present invention relates to a remote control device for remotely controlling an engine of a small vessel or the like.

2. Description of the Related Art

In a small vessel or the like, control devices for controlling a propellant engine, steering mechanism, etc. are fixed mainly in a cockpit. In some cases, the vessel is furnished with a remote control device that can be used to control the engine or the like in any other place than the cockpit, depending on the situations. In a conventional remote control device for small vessel, dial-type knobs for starboard and port engines, a dial-type steering knob, etc., for example, are arranged flush with one another on an elongate housing.

In the conventional remote control device for small vessel described above, the direction of operation of each knob is not always coincident with the direction in which the vessel actually moves. Further, the location of each knob has no special significance. Accordingly, it is hard for an inexperienced steersman intuitively to judge the moving direction of the vessel when he/she operates the knobs. Thus, use of the remote control device may be bewildering.

Based on these circumstances, the object of the present invention is to provide a remote control device for small vessel, capable of easily precisely controlling a vessel without requiring any veteran skill.

BRIEF SUMMARY OF THE INVENTION

A remote control device according to the present invention comprises a portable housing capable of being held by a steersman, a control lever attached to the housing and rockable back and forth, a displacement sensor for engine control set in the housing and adapted to deliver a forward-control signal for an engine when the control lever is rocked to the front side and to deliver a reverse-control signal for the engine when the control lever is rocked to the rear side, and a locking mechanism capable of holding the control lever in a neutral position. This remote control device can be operated with ease, since the direction of operation of the control lever and the moving direction of a vessel are associated with each other. Thus, the vessel can be steered easily and safely.

In the case where the remote control device of the invention is applied to a vessel that is furnished with propellant engines on the port and starboard sides, individually, it is advisable to provide the left-hand portion of the housing with a control lever for controlling a port engine and provide the right-hand portion of the housing with a control lever for controlling a starboard engine. According to this arrangement, the port and starboard engines can be controlled independently of each other by means of the left- and right-hand control levers. Thus, the controlled engine, left- or right-hand, and the direction in which the vessel moves can be judged with ease. Only one control lever is needed in the case where the remote control device of the invention is applied to a vessel that is furnished with only one engine.

Preferably, the remote control device of the invention may further comprise a steering knob, provided on the upper surface of the housing and movable from side to side, and a displacement sensor for steering, set in the housing and adapted to deliver a control signal for steering the vessel to the port side to a steering mechanism when the steering knob is moved to the left and to deliver a control signal for steering the vessel to the starboard side to the steering mechanism when the steering knob is moved to the right. According to this arrangement, the vessel can be steered to the port side when the steering knob on the upper surface of the housing is moved to the left. The vessel can be steered to the starboard side when the steering knob is moved to the right. Thus, the relationship between the direction of operation of the steering knob and the moving direction of the vessel can be grasped with ease.

Preferably, moreover, the remote control device of the invention may further comprise a thruster knob, provided on the upper surface of the housing and movable from side to side, and a displacement sensor for thruster, set in the housing and adapted to deliver a control signal for moving the body of the vessel to the port side to a side thruster when the thruster knob is moved to the left and to deliver a control signal for moving the vessel body to the starboard side to the side thruster when the thruster knob is moved to the right. According to this arrangement, the vessel body can be moved to the port side when the thruster knob on the upper surface of the housing is moved to the left. The vessel body can be steered to the starboard side when the thruster knob is moved to the right. Thus, the relationship between the direction of operation of the thruster knob and the moving direction of the vessel can be grasped with ease.

Preferably, furthermore, the remote control device of the invention may further comprise a selector switch for switching between the remote control device and a main control device fixed to the body of the vessel and indicator means such as an indicator lamp for indicating the selected control device. According to this arrangement, the switching of the control means from the main control device over to the remote control device can be securely noticed by means of the indicator means on the operating-hand side.

Preferably, moreover, the portable housing may be provided with an emergency stop switch for stopping the operation of the engine in case of emergency. According to this arrangement, the emergency stop switch is activated if an emergency such as a fall in water occurs while the remote control device is being operated. If this is done, the engine operation can be stopped without delay, so that the safety is further improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
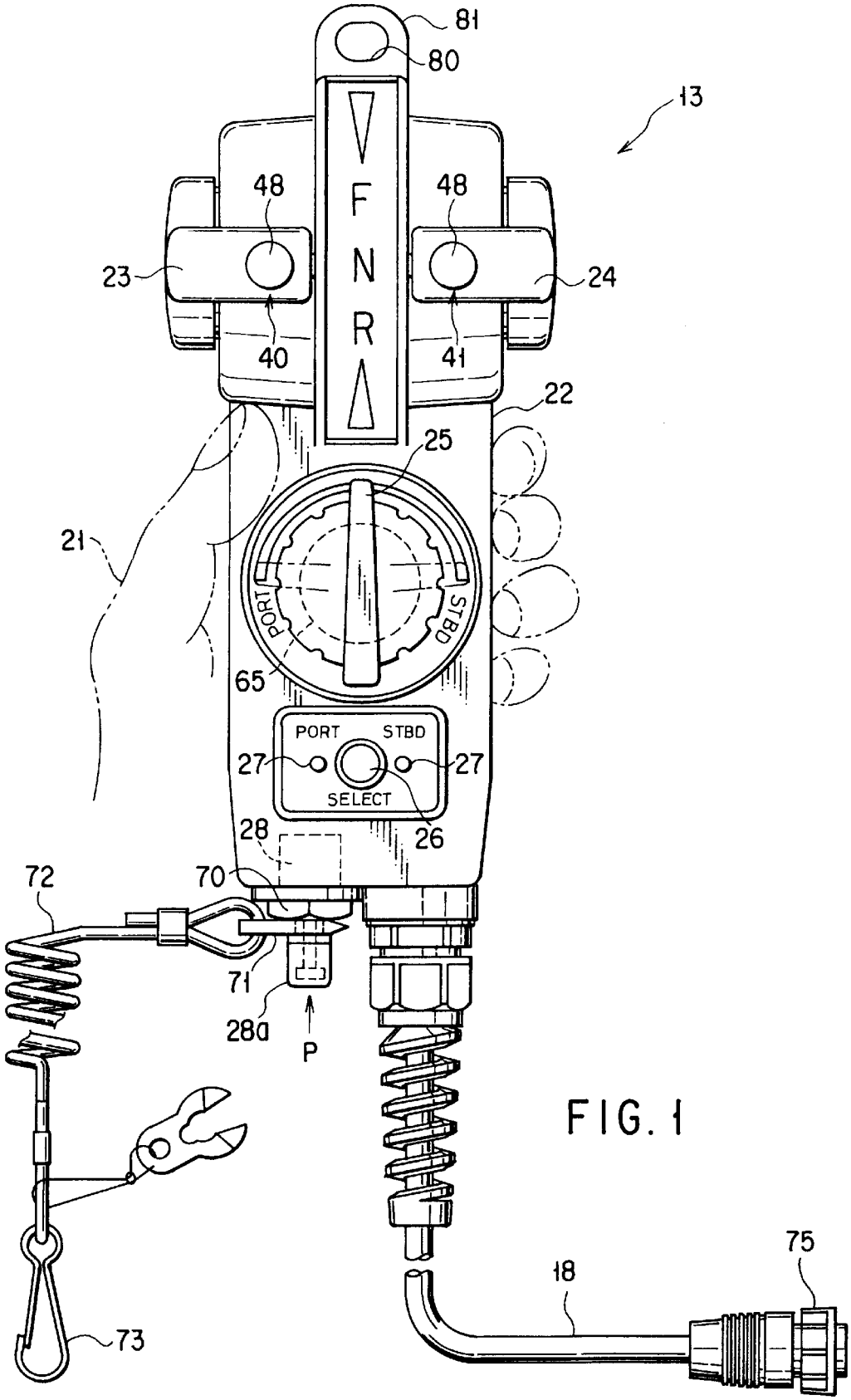
FIG. 1 is a plan view of a remote control device for a small vessel according to a first embodiment of the present invention.
Figure 2:
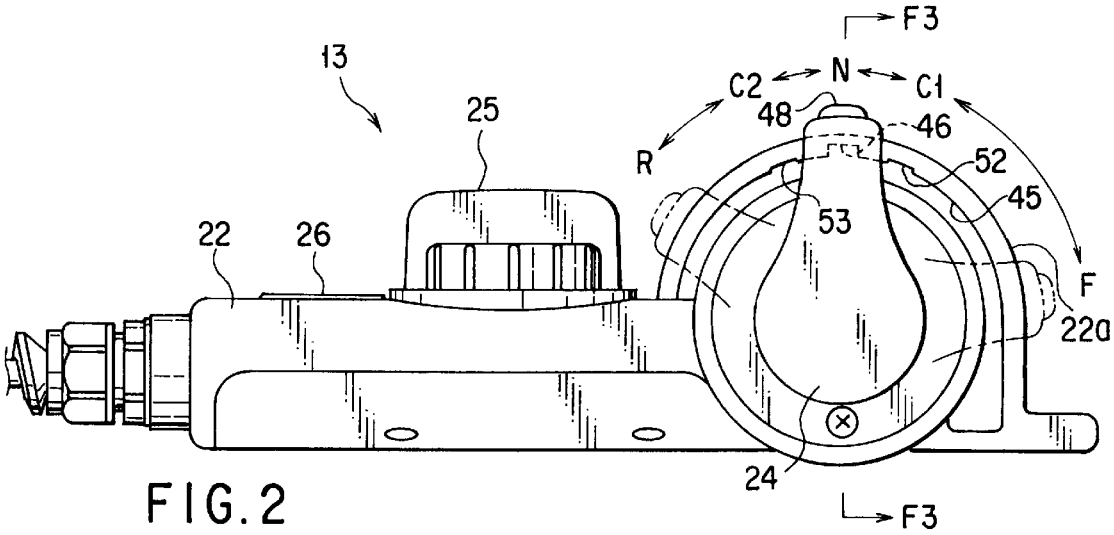
FIG. 2 is a side view of the remote control device shown in FIG. 1.

A first embodiment of the present invention will now be described with reference to FIGS. 1 to 5. A small vessel 10 shown in FIG. 5 is furnished with a main control device 12 fixed in a cockpit or the like of a vessel body 11 and a portable remote control device 13 that is not fixed to the vessel body 11. The main control device 12 is provided with a control lever 14. A control cable 15, such as a mechanical push-pull cable or an electrical cable, is connected to the main control device 12. As the control lever 14 is operated, a propellant engine 16 is subjected to clutch control and throttle control by means of the control cable 15. The main control device 12 can also control a steering mechanism 17 by means of a steering member (not shown).

The remote control device 13 is provided with a selector switch 26, which will be mentioned later. The engine control can be switched from the main control device 12 over to the remote control device 13 by operating the selector switch 26. The remote control device 13 can carry out the clutch control and throttle control of the propellant engine 16 and the control of the steering mechanism 17 by means of an electric cable 18.

The following is a detailed description of a configuration of the remote control device 13.

The remote control device 13 shown in FIG. 1 is provided with a portable housing 22, a pair of control levers 23 and 24 located individually on the opposite side portions, left and right, of the housing 22, a steering knob 25 on the upper surface of the housing 22, the selector switch 26, indicators 27 such as indicator lamps, emergency stop switch 28, etc. The housing 22 has a shape and size such that a steersman can hold it in his/her hand 21.

The control lever 23 on the left-hand side portion of the housing 22 is used to control a port engine 16*a*. The control lever 24 on the right-hand side portion of the housing 22 is used to control a starboard engine 16*b*. The control levers 23 and 24 can be independently rocked back and forth with respect to a neutral position N (NEUTRAL), which is indicated by full line in FIG. 2. More specifically, the control levers 23 and 24 can be leveled from the neutral position N to a front full-throttle position F via a forward-side clutching position C1 and also moved to a rear full-throttle position R via a reverse-side clutching position C2.

Figure 3:
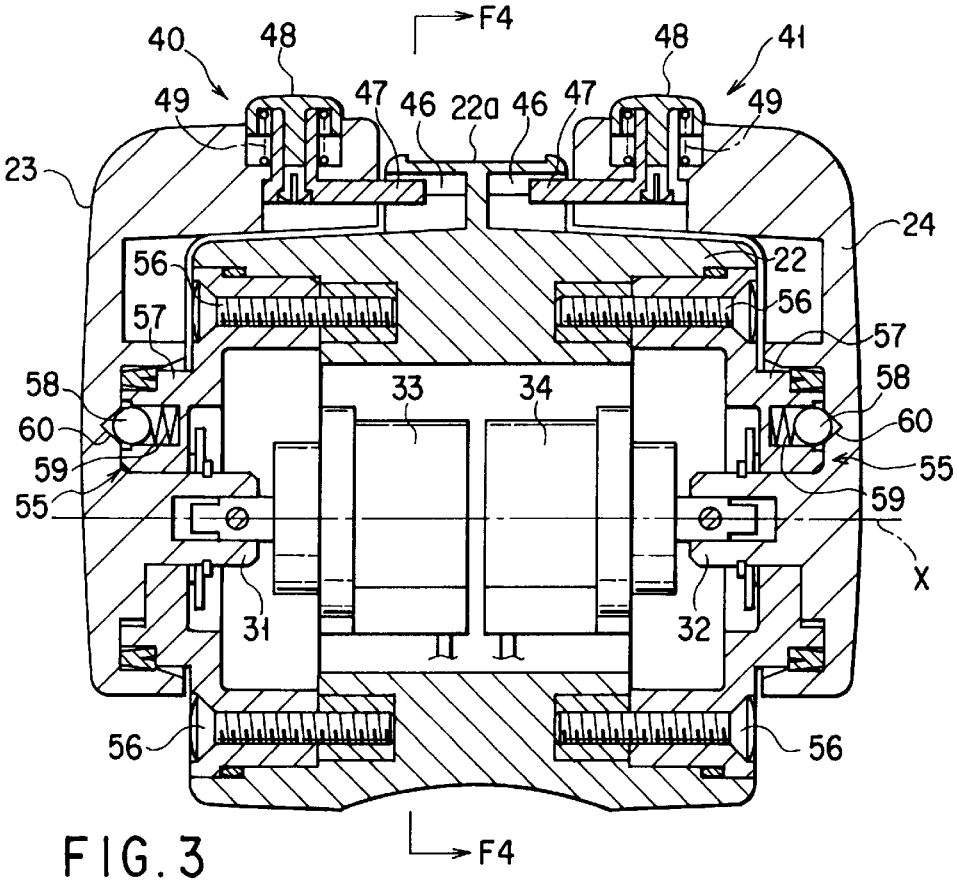
FIG. 3 is a sectional view of the remote control device taken along line F3—F3 of FIG. 2.

As shown in FIG. 3, the control levers 23 and 24 can rock around independent shaft portions 31 and 32, respectively, which extend along a common axis X. Potentiometers 33 and 34 are set in the housing 22. They are displacement sensors for engine control that are used to detect the respective rotational positions of the shaft portions 31 and 32.

The one potentiometer 33 delivers electric signals for the clutch control and throttle control of the port engine 16*a*, based on the rotational angle of the left-hand control lever 23, to the engine 16*a* when the lever 23 is moved forward or backward. The other potentiometer 34 delivers electric signals for the clutch control and throttle control of the starboard engine 16*b*, based on the rotational angle of the right-hand control lever 24, to the engine 16*b* when the lever 24 is moved forward or backward.

The remote control device 13 of this embodiment is provided with locking mechanisms 40 and 41 that can hold the control levers 23 and 24, respectively, in the neutral position N. Since the remote control device 13 that is provided with the control levers 23 and 24 has a bisymmetrical configuration, the one control lever 23 will now be described representatively.

As shown in FIG. 3, the locking mechanism 40 is composed of a first recess 46 in an inner peripheral surface 45 (arcuate surface around the axis X) of an outer peripheral wall portion 22*a* of the housing 22, an engaging member 47 capable of being fitted in the first recess 46, an unlocking knob 48, an elastic member 49, etc. The unlocking knob 48 can drive the engaging member 47 to get out of the first recess 46. The elastic member 49 urges the engaging member 47 to be fitted into the first recess 46. When the engaging member 47 is fitted in the first recess 46, the control lever 23 ceases to be able to move back and forth. If the unlocking knob 48 is pushed, the engaging member 47 is disengaged from the first recess 46, whereupon the control lever 23 is allowed to move back and forth.

Figure 4:
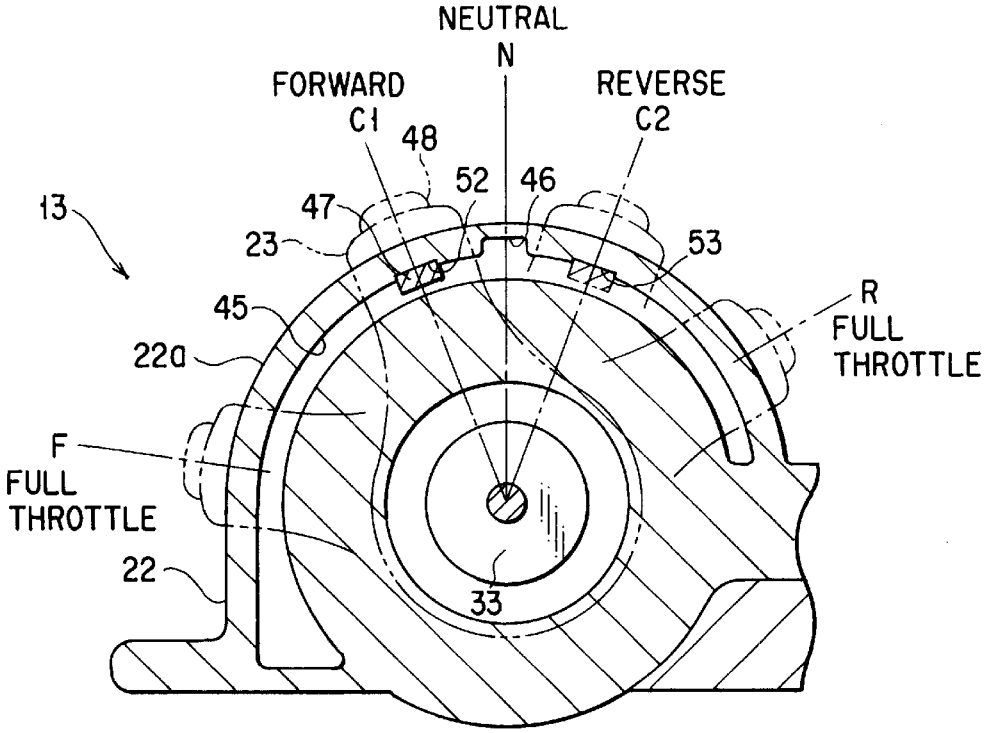
FIG. 4 is a sectional view of the remote control device taken along line F4—F4 of FIG. 3.
Figure 5:
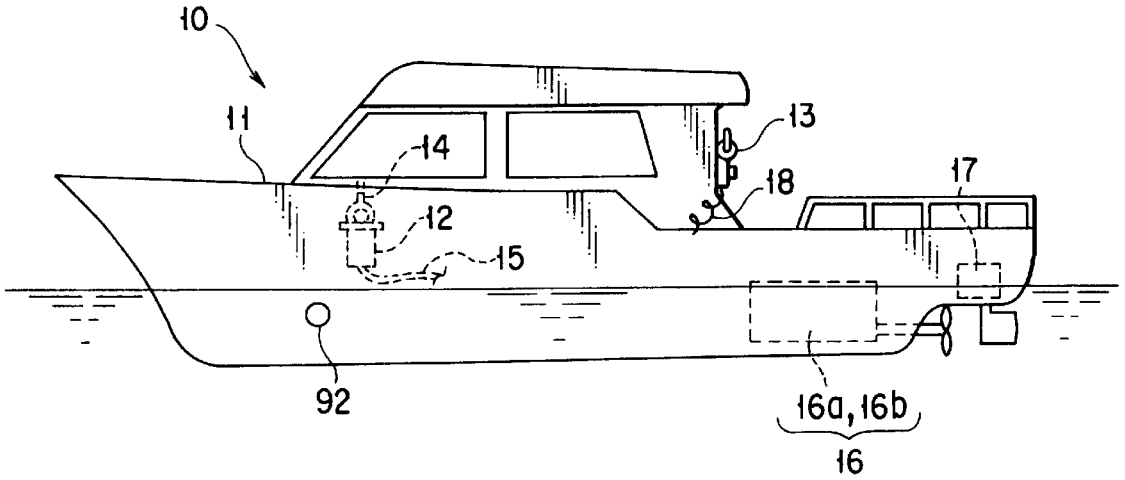
FIG. 5 is a side view of a small vessel furnished with the remote control device shown in FIG. 1.

As shown in FIG. 4, a second recess 52, which is shallower than the first recess 46, is formed in that position on the inner peripheral surface 45 of the outer peripheral wall portion 22*a* of the housing 22 which corresponds to the forward-side clutching position C1. If the lever 23 is pushed forward or backward without depressing the unlocking knob 48 when the engaging member 47 is in engagement with the recess 52, the engaging member 47 is disengaged from the recess 52, whereupon the lever 23 is allowed to move forward or backward.

A third recess 53, which is shallower than the first recess 46, is formed in that position on the inner peripheral surface 45 which corresponds to the reverse-side clutching position C2. If the lever 23 is pushed forward or backward without depressing the unlocking knob 48 when the engaging member 47 is in engagement with the recess 53, the engaging member 47 is disengaged from the recess 53, whereupon the lever 23 is allowed to move forward or backward.

As shown in FIG. 3, the remote control device 13 is provided with click-stop mechanisms 55 that are arranged individually for the control levers 23 and 24. The click-stop mechanisms 55 serve to produce a feeling of a click in the neutral position N and clutching positions C1 and C2 when the levers 23 and 24 are moved back and forth with the unlocking knob 48 kept depressed.

Since the left- and right-hand click-stop mechanisms 55 shares a configuration with each other, the click-stop mechanism 55 that is used in the left-hand control lever 23 will be described representatively. The click-stop mechanism 55 is composed of a click element 58 such as a metal ball in a bearing member 57, spring 59, first socket 60, second socket (not shown), third socket (not shown), etc. The bearing member 57 is fixed to the housing 22 by means of bolts 56. The spring 59 urges the click element 58 toward the inside face of the control lever 23. When the lever 23 moves to the neutral position N, the click element 58 is fitted into the first socket 60. When the lever 23 is situated in the forward-side clutching position C1, the click element 58 is fitted in the second socket. When the lever 23 is situated in the reverse-side clutching position C2, the click element 58 is fitted in the third socket.

As shown in FIG. 1 and other drawings, the steering knob 25 that is rockable from side to side is provided on the upper surface of the housing 22. A potentiometer 65 is set in the housing 22. The potentiometer 65 is an example of a displacement sensor for steering that is interlocked with the steering knob 25. When the steering knob 25 is rotated counter-clockwise, the potentiometer 65 delivers a control signal to the steering mechanism 17 such that the vessel is steered to the port side in accordance with the rotational angle of the knob 25. When the steering knob 25 is rotated clockwise, the potentiometer 65 delivers a control signal to the steering mechanism 17 such that the vessel is steered to the starboard side in accordance with the rotational angle of the knob 25.

The selector switch 26 serves to switch the control means from the main control device 12 over to the remote control device 13. When the switch 26 is turned on, the control means is switched from the main control device 12 over to the remote control device 13, and the indicators 27 are switched on.

A knob 28*a* of the emergency stop switch 28 shown in FIG. 1 is continually urged in the direction of arrow P by means of a spring (not shown). When a spacer 71 is inserted in a gap between the knob 28*a* and a support seat 70, an electric circuit is formed to continue operation of the engine 16. When the spacer 71 is drawn out of the gap between the knob 28*a* and the seat 70, an electric circuit is formed to stop the operation of the engine 16.

A string 72 is connected to the spacer 71. A connecting member 73 such as a clip is attached to the other end of the string 72. If the steersman accidentally falls into water with the remote control device 13 in his/her hand when the connecting member 73 is coupled to the vessel body 11, the string 72 is pulled. If the spacer 71 is drawn out from the knob 28*a* when the string 72 is stretched to its full length, the knob 28*a* moves in the direction of arrow P to activate the switch 28. The engine 16 stops automatically in this manner.

When the connecting member 73 is connected to the steersman's body, the string 72 is pulled if the steersman falls into water and releases his/her hold of the remote control device 13. Since the emergency stop switch 28 is activated when the spacer 71 is drawn out from the knob 28*a* with the string 72 stretched to its full length, the engine 16 can be stopped automatically. If the steersman pushes the knob 28*a* in the direction of arrow P in FIG. 1 with his/her finger when the spacer 71 is interposed between the knob 28*a* and the support seat 70, the emergency stop switch 28 can be activated to stop the engine 16.

In the housing 22, one end of the electric cable 18 is connected to electric components, including the potentiometers 33, 34 and 65, switches 26 and 28, indicators 27, etc. A waterproof connector 75 is provided on the other end of the electric cable 18. The connector 75 can be connected electrically and mechanically to the terminal area of a control circuit for the engine 16 in a detachable manner. A catch portion 81 is formed on an end portion of the housing 22. The catch portion 81 can be hanged to a support hook or the like that is provided on the vessel body 11.

The following is a description of the function of the remote control device 13.

In actuating the remote control device 13, the selector switch 26 is operated to switch the control means from the main control device 12 over to the control device 13. This switching of the control means over to the remote control device 13 can be confirmed by watching the indicators 27.

As shown in FIG. 1, the steersman holds the remote control device 13 with the hand 21. If the control levers 23 and 24 are moved from the neutral position N to the forward-side clutching position C1 (shown in FIG. 2), the clutch of the engine 16 is shifted to the forward side. If the control levers 23 and 24 are moved from the forward-side clutching position C1 to the full-throttle position F, the engine 16 is speeded up depending on the angle of operation of the levers 23 and 24.

If the control levers 23 and 24 are moved from the neutral position N to the reverse-side clutching position C2, the clutch of the engine 16 is shifted to the reverse side. If the control levers 23 and 24 are leveled from the reverse-side clutching position C2 to the full-throttle position R, the engine 16 is speeded up depending on the operation angle of the levers 23 and 24. The levers 23 and 24 can be operated independently of each other. Thus, the port engine 16*a* and the starboard engine 16*b* can be controlled independently of each other in accordance with the operation angle of the levers 23 and 24.

If the steering knob 25 is turned clockwise, the steering mechanism 17 is actuated in accordance with the rotational angle of the potentiometer 65, whereupon the vessel is steered to the starboard side. If the knob 25 is turned counterclockwise, the steering mechanism 17 is actuated in accordance with the rotational angle of the potentiometer 65, whereupon the vessel is steered to the port side.

Thus, with the remote control device 13 held in the hand 21, the vessel moves in a direction that is settled as the control levers 23 and 24 and the steering knob 25 are operated. Accordingly, the movement of the vessel and the directions of operation of the control levers 23 and 24 and the steering knob 25 can be visually sensuously grasped with ease, so that steering the vessel requires no veteran skill.

Figure 6:
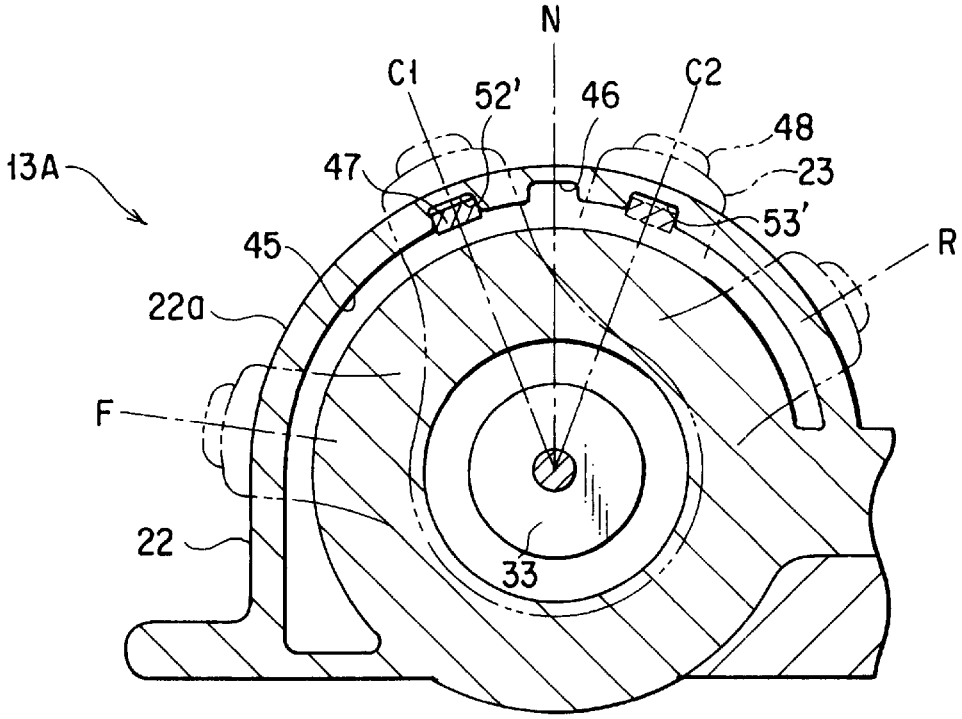
FIG. 6 is a sectional view of a part of a remote control device according to a second embodiment of the invention.

FIG. 6 shows a remote control device 13A according to a second embodiment of the invention. A second recess 52' and a third recess 53' according to this embodiment are deeper than the recesses 52 and 53 of the first embodiment. Therefore, an engaging member 47 can never be disengaged from the recess 52' or 53' unless an unlocking knob 48 is depressed. Thus, control levers 23 and 24 of the remote control device 13A can be locked in three positions, a neutral position N, forward-side clutching position C1, and reverse-side clutching position C2.

Figure 7:
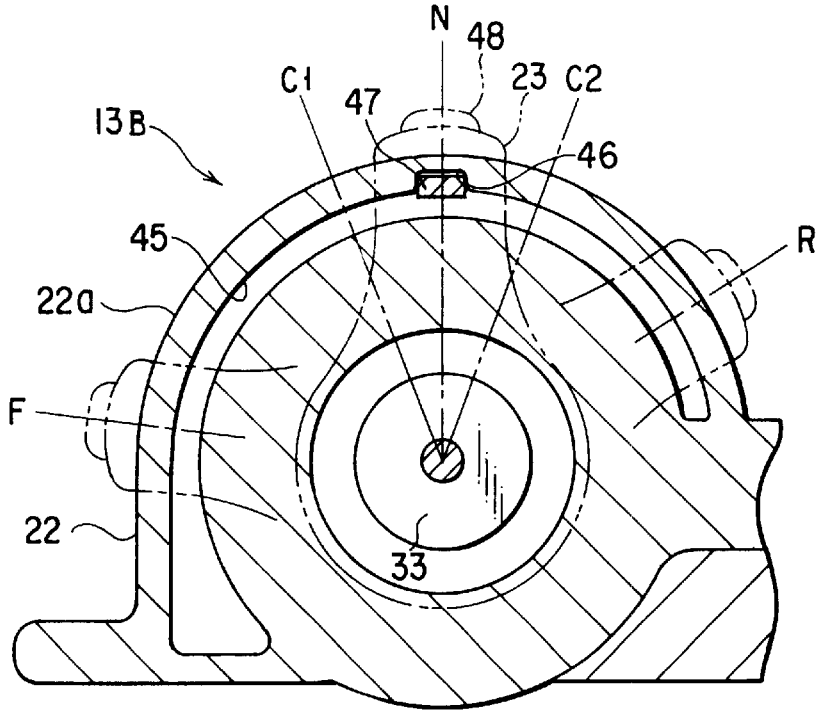
FIG. 7 is a sectional view of a part of a remote control device according to a third embodiment of the invention.

FIG. 7 shows a remote control device 13B according to a third embodiment of the invention. According to this embodiment, a recess 46 is formed in a neutral position N only. Therefore, control levers 23 and 24 can move back and forth without being locked in any other positions than the neutral position N.

Figure 8:
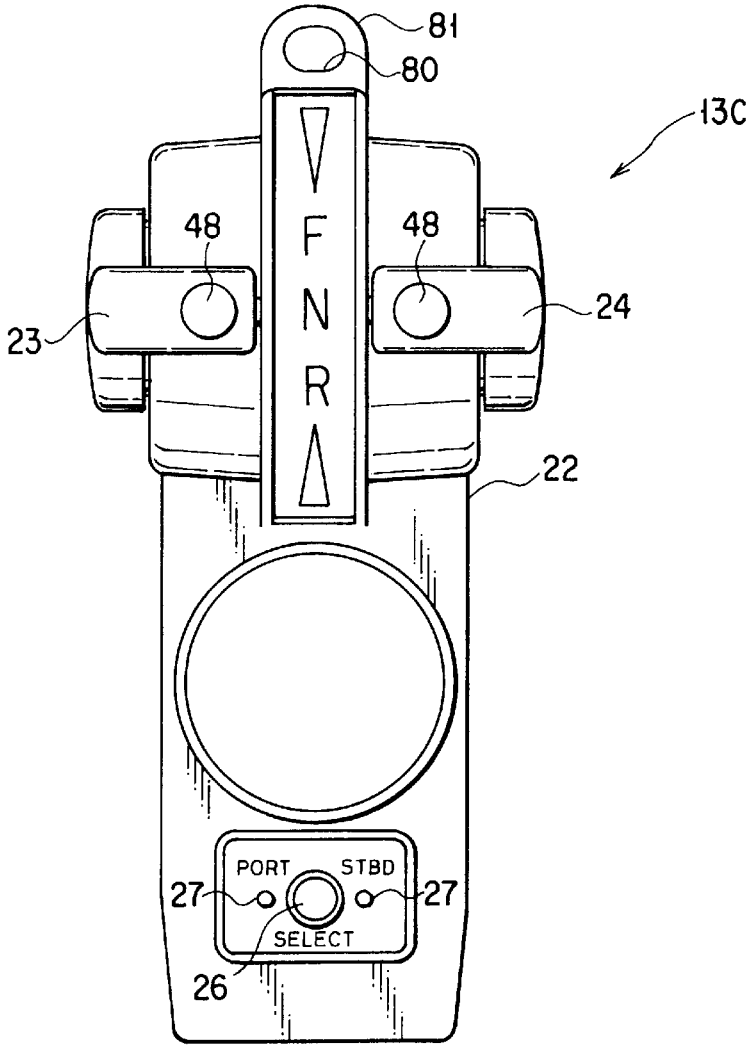
FIG. 8 is a plan view of the principal part of a remote control device according to a fourth embodiment of the invention.
Figure 9:
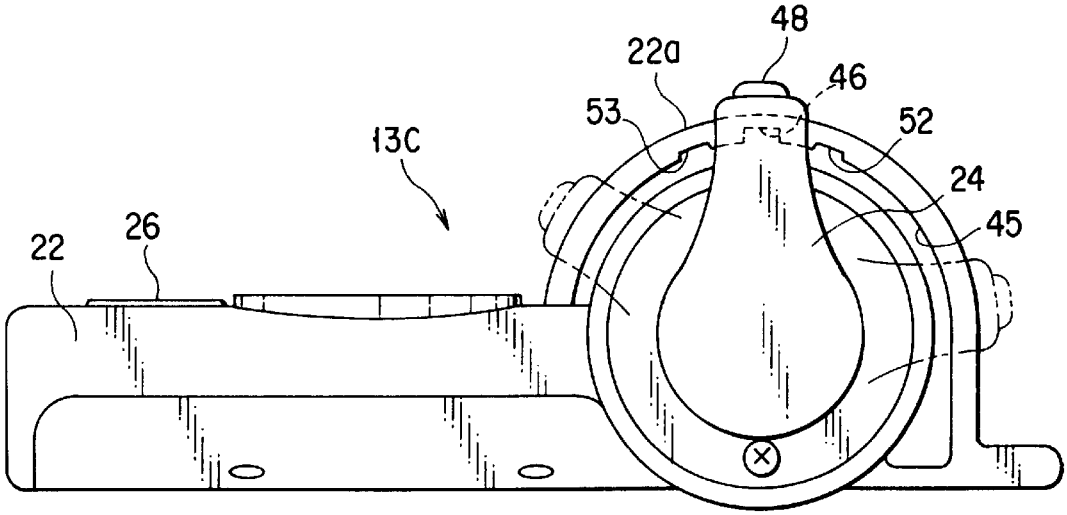
FIG. 9 is a side view of the principal part of the remote control device shown in FIG. 8.

FIGS. 8 and 9 show a remote control device 13C according to a fourth embodiment of the invention. The remote control device 13C of this embodiment differs from the one according to the first embodiment in that it is not provided with the steering knob 25 described in the first embodiment. A description of other components, functions, and effects of the fourth embodiment is omitted, since they are shared with the remote control device 13 of the first embodiment. The remote control device 13C, like the one according to the foregoing embodiments, can change the course of the vessel by separately operating a port engine 16*a* and a starboard engine 16*b* by means of left- and right-hand control levers 23 and 24.

Figure 10:
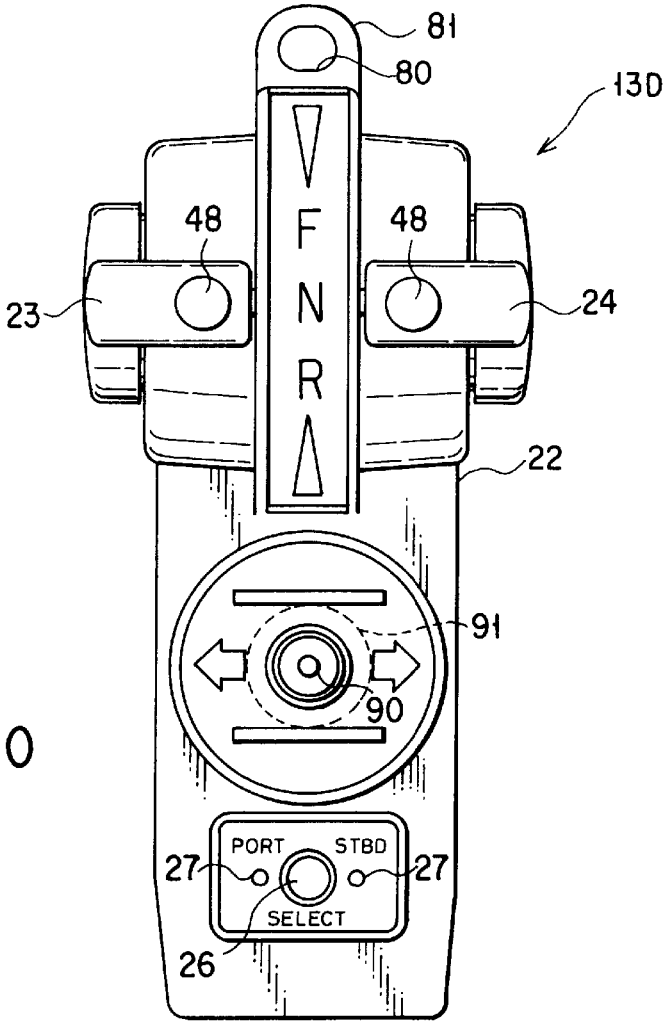
FIG. 10 is a plan view of the principal part of a remote control device according to a fifth embodiment of the invention.
Figure 11:
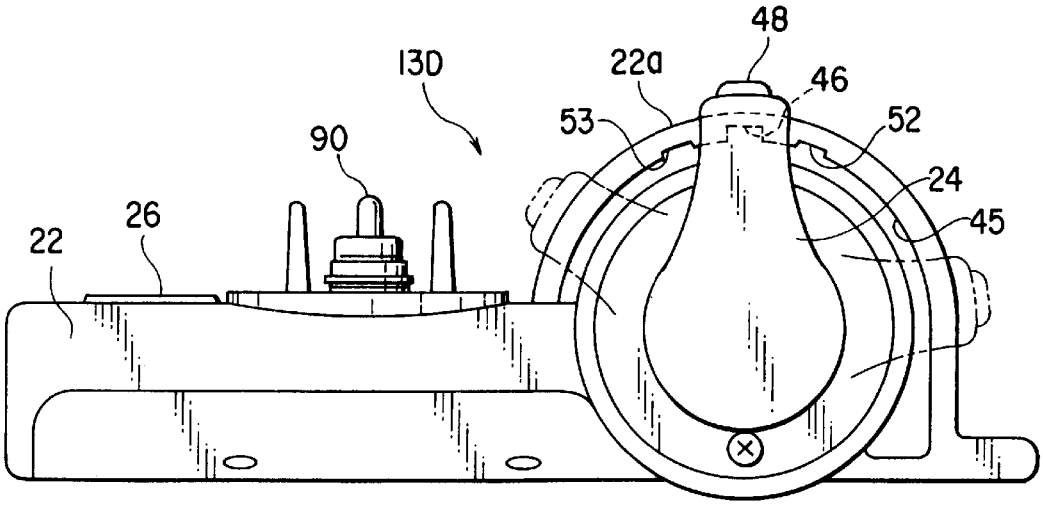
FIG. 11 is a side view of the principal part of the remote control device shown in FIG. 10.

FIGS. 10 and 11 show a remote control device 13D according to a fifth embodiment of the invention. The remote control device 13D is provided with a thruster knob 90 and a displacement sensor 91 for thruster in the housing 22, in place of the steering knob 25 of the remote control device 13 of the first embodiment. The knob 90, which is located on the upper surface of a housing 22, is movable from side to side.

If the thruster knob 90 is moved to the left, the displacement sensor 91 for thruster delivers a control signal for moving the vessel to the port side to a side thruster 92 (shown in FIG. 5). If the knob 90 is moved to the right, the sensor 91 delivers a control signal for moving the vessel to the starboard side to the side thruster 92. A description of other components than the knob 90 and the sensor 91 and other functions and effects of the fifth embodiment is omitted, since they are shared with the remote control device 13 of the first embodiment.

It is to be understood, in carrying out the present invention described above in connection with the foregoing embodiments, that the components of the invention including the housing, control levers, displacement sensors for engine control, steering knob, displacement sensor for steering, selector switch, indicators, thruster knob, etc. of the remote control device may be suitably changed or modified. If the vessel is of a one-engine type, moreover, it is necessary only that the remote control device be provided with only one control lever.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A remote control device for a small vessel, comprising:

a portable housing capable of being held by a steersman;

a at least one control lever attached to the housing and rockable back and forth;

a displacement sensor for engine control set in the housing and adapted to deliver a forward-control signal for an engine when the control lever is rocked forward and to deliver a reverse-control signal for the engine when the control lever is rocked backward;

a locking mechanism capable of holding the control lever in a neutral position;

an emergency stop switch provided on the portable housing for stopping operation of the engine in case of emergency.

2. A remote control device according to claim 1, wherein a left-hand portion of said housing is provided with a control lever for controlling a port engine, and a right-hand portion of said housing is provided with a control lever for controlling a starboard engine.

3. A remote control device according to claim 2, which further comprises a steering knob provided on an upper surface of the housing and movable from side to side, and a displacement sensor for steering set in the housing and adapted to deliver a control signal to a steering mechanism for steering the vessel to the port side when the steering knob is moved to the left and to deliver a control signal to the steering mechanism for steering the vessel to the starboard side when the steering knob is moved to the right.

4. A remote control device according to claim 3, which further comprises a selector switch for switching between the remote control device and a main control device fixed to the body of the vessel and indicator means for indicating the selected control device.

5. A remote control device according to claim 2, which further comprises a thruster knob provided on an upper surface of the housing and movable from side to side, and a displacement sensor for thrust set in the housing and adapted to deliver a control signal to a side thruster for moving the body of the vessel to the port side when the thruster knob is moved to the left and to deliver a control signal to the side thruster for moving the vessel body to the starboard side when the thruster knob is moved to the right.

6. A remote control device according to claim 5, which further comprises a selector switch for switching between the remote control device and a main control device fixed to the body of the vessel and indicator means for indicating the selected control device.

7. A remote control device according to claim 2, which further comprises a selector switch for switching between the remote control device and a main control device fixed to the body of the vessel and indicator means for indicating the selected control device.

8. A remote control device according to claim 1, which further comprises a steering knob provided on an upper surface of the housing and movable from side to side, and a displacement sensor for steering set in the housing and adapted to deliver a control signal to a steering mechanism for steering the vessel to the port side when the steering knob is moved to the left and to deliver a control signal to the steering mechanism for steering the vessel to the starboard side when the steering knob is moved to the right.

9. A remote control device according to claim 8, which further comprises a selector switch for switching between the remote control device and a main control device fixed to the body of the vessel and indicator means for indicating the selected control device.

10. A remote control device according to claim 1, which further comprises a thruster knob provided on an upper surface of the housing and movable from side to side, and a displacement sensor for thrust set in the housing and adapted to deliver a control signal to a side thruster for moving the body of the vessel to the port side when the thruster knob is moved to the left and to deliver a control signal to the side thruster for moving the vessel body to the starboard side when the thruster knob is moved to the right.

11. A remote control device according to claim 10, which further comprises a selector switch for switching between the remote control device and a main control device fixed to the body of the vessel and indicator means for indicating the selected control device.

12. A remote control device according to claim 1, which further comprises a selector switch for switching between the remote control device and a main control device fixed to the body of the vessel and indicator means for indicating the selected control device.

13. A remote control device for a small vessel, comprising:

a portable housing capable of being held by a steersman;

at least one control lever attached to the housing and rockable back and forth;

a displacement sensor for engine control set in the housing and adapted to deliver a forward-control signal for an engine when the control lever is rocked forward and to deliver a reverse-control signal for the engine when the control lever is rocked backward;

a locking mechanism capable of holding the control lever in a neutral position;

a thruster knob provided on an upper surface of the housing and movable from side to side; and a displacement sensor for thrust set in the housing and adapted to deliver a control signal to a side thruster for moving the body of the vessel to the port side when the thruster knob is moved to the left and to deliver a control signal to the side thruster for moving the vessel body to the starboard side when the thruster knob is moved to the right.

14. A remote control device according to claim 13, wherein a left-hand portion of said housing is provided with a control lever for controlling a port engine, and a right-hand portion of said housing is provided with a control lever for controlling a starboard engine.

15. A remote control device according to claim 14, which further comprises a selector switch for switching between the remote control device and a main control device fixed to the body of the vessel and indicator means for indicating the selected control device.

16. A remote control device according to claim 13, which further comprises a selector switch for switching between the remote control device and a main control device fixed to the body of the vessel and indicator means for indicating the selected control device.

* * * * *